US011585015B2

(12) United States Patent
Abels et al.

(10) Patent No.: US 11,585,015 B2
(45) Date of Patent: Feb. 21, 2023

(54) PROCESS FOR THE PREPARATION OF POLYMER FIBERS FROM POLYMERS DISSOLVED IN IONIC LIQUIDS BY MEANS OF AN AIR GAP SPINNING PROCESS

(71) Applicant: Deutsche Institute fur Textil-und Faserforschung, Denkendorf (DE)

(72) Inventors: Falko Abels, Roemerberg (DE); Tomasz Cwik, Mannheim (DE); Ronald Beyer, Winnenden (DE); Frank Hermanutz, Leonberg (DE)

(73) Assignee: DEUTSCHE INSTITUTE FUR TEXTIL-UND FASERFORSCHUNG DENKENDORF, Denkendorf (DE)

( * ) Notice: Subject to any disclaimer, the term of this patent is extended or adjusted under 35 U.S.C. 154(b) by 308 days.

(21) Appl. No.: 16/077,344

(22) PCT Filed: Feb. 1, 2017

(86) PCT No.: PCT/EP2017/052078

§ 371 (c)(1),
(2) Date: Aug. 10, 2018

(87) PCT Pub. No.: WO2017/137284

PCT Pub. Date: Aug. 17, 2017

(65) Prior Publication Data

US 2019/0048490 A1 Feb. 14, 2019

(30) Foreign Application Priority Data

Feb. 11, 2016 (EP) ..... 16155254

(51) Int. Cl.
*D01D 5/06* (2006.01)
*D01F 2/02* (2006.01)
*D01F 2/00* (2006.01)

(52) U.S. Cl.
CPC ..... *D01D 5/06* (2013.01); *D01F 2/00* (2013.01); *D01F 2/02* (2013.01)

(58) Field of Classification Search
CPC ..... D01F 2/00; D01F 2/02
See application file for complete search history.

(56) References Cited

U.S. PATENT DOCUMENTS 4,246,221 A * 1/1981 McCorsley, III ..... D01F 2/00 264/203
4,283,186 A * 8/1981 Keith ..... A24D 3/10 131/345
5,417,909 A * 5/1995 Michels ..... B29C 55/00 264/177.13
5,534,113 A * 7/1996 Quigley ..... B01D 1/225 159/49
6,183,865 B1 * 2/2001 Yabuki ..... D01F 2/00 428/364
6,756,001 B2 * 6/2004 Meraldi ..... D01F 2/00 264/187
8,163,215 B2 * 4/2012 Stegmann ..... C08B 16/00 264/211.1
8,952,146 B2 * 2/2015 Kapoor ..... D01F 2/02 536/124
10,190,242 B2 * 1/2019 Chou ..... D01D 1/02
2003/0157351 A1 * 8/2003 Swatloski ..... C08L 1/06 428/478.4
2008/0269477 A1 * 10/2008 Stegmann ..... C08B 1/003 536/57
2012/0029150 A1 * 2/2012 Hadba ..... A61L 27/34 525/54.1
2012/0253030 A1 * 10/2012 Kapoor ..... C08B 1/003 536/56
2017/0107644 A1 * 4/2017 Chou ..... D01D 1/02

FOREIGN PATENT DOCUMENTS

GB 2451046 B 6/2011
KR 101472095 B1 12/2014
WO 2007128268 A2 11/2007
WO 2011048609 A2 4/2011

* cited by examiner

*Primary Examiner* — Joseph S Del Sole
*Assistant Examiner* — Baileigh Kate Darnell
(74) *Attorney, Agent, or Firm* — Lippes Mathias LLP

(57) ABSTRACT

The invention relates to a process for the production of polymer fibers from polymers dissolved in ionic liquids by means of an air gap spinning process, characterized in that a) a spinning solution that contains an ionic liquid and a dissolved polymer is produced; b) said spinning solution is guided through an extruder before it is divided into fibers via a die; and c) the obtained fibers are guided via an air gap through a coagulation bath.

15 Claims, No Drawings

PROCESS FOR THE PREPARATION OF POLYMER FIBERS FROM POLYMERS DISSOLVED IN IONIC LIQUIDS BY MEANS OF AN AIR GAP SPINNING PROCESS

The invention relates to a process for the production of polymer fibers from polymers dissolved in ionic liquids by means of an air gap spinning process, characterized in that a) a spinning solution that contains an ionic liquid and a dissolved polymer is produced;

b) said spinning solution is guided through an extruder before it is divided into fibers via a die; and c) the obtained fibers are guided via an air gap through a coagulation bath.

For the production of polymer fibers, various spinning processes have been described. Of importance are the wet spinning process and the dry spinning process.

In the wet spinning process, the spinning solution that contains the dissolved polymer is guided directly into a precipitation bath. In the precipitation bath, the polymer coagulates and the obtained fibers are spun directly from the precipitation bath.

In the dry spinning process, the spinning solution is forced through a spinning die and then guided through a tempered air gap. In the air gap, the exiting jets of the spinning solution solidify into fibers. A special form of the dry spinning process is the dry-wet spinning process. In a dry-wet spinning process, the obtained fibers are guided, after passing through the air gap, into a coagulation bath which contains a precipitant for the polymer. In this coagulation bath, the fibers solidify further.

Such a dry-wet spinning process is described for the production of cellulosic fibers. For example, DE-A 4444140 and U.S. Pat. No. 4,246,221 disclose the production of cellulosic fibers from spinning solutions that contain cellulose and, as solvent, N-methylmorpholine-N-oxide (NMMO) (Lyocell® process).

Such processes are also known for spinning solutions that contain cellulose and, as solvent, ionic liquids, see WO 2006/000197, WO 2007/076979 and WO 2009/118262.

Cellulosic fibers are predominantly produced by the viscose process. The obtained fibers are called viscose fibers. In the viscose process, pulp that was obtained by the kraft process from wood, for example, is dissolved by a chemical reaction. Using alkali and carbon disulfide, cellulose xanthate is obtained. Said cellulose xanthate dissolves after addition of acid with the elimination of carbon disulfide.

The processes described above are alternative processes to the viscose process. In principal, they have the advantage that carbon disulfide and carbon disulfide reaction can be dispensed with.

It is desired that the performance properties of the cellulosic fibers produced by means of the alternative processes correspond to or exceed those of the viscose fibers. Such properties are in particular the strengths of the fiber, its elasticity, its modulus of elasticity. In particular, the obtained fibers should be as uniform and homogeneous as possible, that is to say that as far as possible all fibers have the same properties.

The object of the present invention was therefore a process for the production of polymer fibers, in which polymer fibers having the best possible performance properties are obtained. In particular, the process should be well suited for the production of cellulosic fibers; the obtained cellulosic fibers should at least achieve the performance properties of the viscose fiber and exceed it if possible.

The Polymer Fibers

The polymer fibers produced by the above process are preferably polymeric fibers made from renewable resources. Preferably, it is cellulosic fibers.

The Ionic Liquid

The ionic liquid is preferably salts which have a melting point of less than 100° C. under atmospheric pressure (1 bar). Particular preferred are salts which are liquid at 21° C., 1 bar. The term ionic liquid here also includes mixtures of different salts.

Preferably, the ionic liquid is salts of an organic cation and an anion.

Suitable organic cations are, in particular, organic cations with heteroatoms, such as nitrogen, sulfur, oxygen or phosphorus.

In particular, the organic cations are compounds having an ammonium group (ammonium cations), an oxonium group (oxonium cations), a sulfonium group (sulfonium cations) or a phosphonium group (phosphonium cations).

Preferably, it is organic cation having at least one nitrogen atom.

In a particular embodiment, the organic cations are ammonium cations, which here are understood to mean non-cyclic cations with tetravalent nitrogen and localized positive charge on the nitrogen atom (quaternary ammonium compounds), or heterocyclic cations having at least one, preferably one to three nitrogen atoms in the ring system.

Quaternary ammonium cations include in particular those having three or four aliphatic substituents on the nitrogen atom. Such aliphatic substituents are, in particular, C1 to C12 alkyl groups or C1 to C12 hydroxyalkyl groups.

Preferred organic cations having at least one nitrogen are organic, heterocyclic cations having one to three, in particular one or two, nitrogen atoms as constituent of the heterocyclic ring system.

Suitable ring systems include monocyclic, bicyclic, aromatic or non-aromatic ring systems.

Also mention may be made of, e.g., bicyclic systems, such as those described in WO 2008/043837. The bicyclic systems of WO 2008/043837 are diazabicyclo derivatives, preferably consisting of a 7 and a 6-membered ring, which contain an amidinium group; in particular, the 1,8-diazabicyclo(5.4.0)undec-7-enium cation may be mentioned.

Particularly suitable are monocyclic cations, such as pyridinium cations, pyridazinium cations, pyrimidinium cations, pyrazinium cations, imidazolium cations, pyrazolium cations, pyrazolinium cations, imidazolinium cations, thiazolium cations, triazolium cations, pyrrolidinium cations and imidazolidinium cations. These cations are listed in WO 2005/113702, for example. As far as it is necessary for a positive charge on the nitrogen atom or in the aromatic ring system, the nitrogen atoms are in each case substituted by a hydrogen atom or an organic group having generally not more than 20 C atoms, preferably a hydrocarbon group, in particular a C1 to C16 alkyl group, in particular a C1 to C10, particularly preferably a C1 to C4 alkyl group.

The carbon atoms of the ring system may also be substituted by organic groups having generally not more than 20 carbon atoms, preferably a hydrocarbon group, in particular a C1 to C16 alkyl group, in particular a C1 to C10, particularly preferably a C1 to C4 alkyl group.

Particularly preferred cations are imidazolium cations, pyrimidinium cations and pyrazolium cations.

Very particularly preferred cations are imidazolium cation of the formula I below

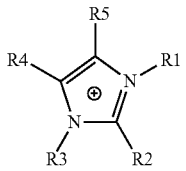

wherein

R1 represents an organic radical having 1 to 20 carbon atoms, and

R2, R3, R4 and R5 represent an H atom or an organic radical having 1 to 20 C atoms.

In formula I, preferably, R1 and R3 independently represent an organic radical having 1 to 10 C atoms. In particular, R1 and R3 represent an aliphatic radical, in particular an aliphatic radical without further heteroatoms, e.g. an alkyl group. Particularly preferably, R1 and R3 independently represent a C1 to C10 and a C1 to C4 alkyl group, respectively, very particularly preferably R1 and R3 independently represent a methyl group or an ethyl group.

In formula I, preferably, R2, R4 and R5 independently represent an H atom or an organic radical having 1 to 10 C atoms; in particular, R2, R4 and R5 represent an H atom or an aliphatic radical. Particularly preferably, R2, R4 and R5 independently of represent an H atom or an alkyl group, in particular R2, R4 and R5 independently represent an H atom or a C1 to C4 alkyl group. Very particularly preferably, R2, R4 and R5 each represent an H atom.

The anion belonging to the organic cation may be any anion.

Particularly suitable are the typical anions of ionic liquids, such as, by way of example, Cl—, Br—, BF4-, H3C—COO—, HCOO—, H3C—O—SO3-, H3C—SO3-, F3C—O—SO3-, PF6-, CH3-CH2-COO—SCN—, SO32-, NO3-, ClO4-.

The anions of the ionic liquids are preferably organic anions having at least one carboxylate group, termed carboxylates for short. Preferably, the carboxylates contain only one carboxylate group.

Such carboxylates include, in particular, organic anions having 1 to 20 C atoms and a carboxylate group.

In a preferred embodiment, the carboxylates contain no further heteroatoms apart from the oxygen atoms of the carboxylate group, such as, e.g., the anions of alkane carboxylic acids, alkene carboxylic acids, alkyne carboxylic acids, alkadiene carboxylic acids, alkatriene carboxylic acids, benzoic acid or phenylacetic acid. Suitable carboxylates of the alkane carboxylic acids, alkene carboxylic acids and alkadiene carboxylic acids are also known as fatty acid carboxylates.

Very particularly preferred carboxylates are C1 to C20 alkanoates (carboxylates of alkane carboxylic acids), in particular C1 to C16 alkanoates. Mention may be made, in particular, of the carboxylates of formic acid (C1 carboxylic acid), acetic acid (C2 carboxylic acid), propionic acid (C3 carboxylic acid), n-butyric acid (C4 carboxylic acid), n-valeric acid (C5 carboxylic acid), n-caproic acid (C6 carboxylic acid) n-caprylic acid (C8 carboxylic acid, octanoic acid), n-capric acid (C10 carboxylic acid, decanoic acid), lauric acid (C12 carboxylic acid, dodecanoic acid), palmitic acid (C16 carboxylic acid, hexadecanoic acid) or stearic acid (C18 carboxylic acid).

In a particular embodiment, the anions of the salts are carboxylates of the C6 to C12 alkane carboxylic acids (i.e., C6 to C12 alkanoates), very particularly preferably carboxylates of the C8 alkane carboxylic acids, in particular the n-octanoate.

The ionic liquids are therefore particularly preferably salts
the cation of which is an organic, heterocyclic cation having one to three nitrogen atoms as a constituent of the heterocyclic ring system, and
the anion of which is a carboxylate.

Preferably, such ionic liquids include:

1-ethyl-3-methylimidazolium acetate,
1-methyl-3-methylimidazolium acetate,
1-ethyl-3-ethylimidazolium acetate,
1-ethyl-3-methylimidazolium octanoate,
1-methyl-3-methylimidazolium octanoate,
1-ethyl-3-ethylimidazolium octanoate, The Process Step a)

In process step a), a spinning solution is produced that contains an ionic liquid and a dissolved polymer.

The polymer is preferably cellulose, see comments above for the polymer fibers.

The cellulose is obtained in particular from wood or other plant materials, mention may be made of wood such as beech, spruce, eucalyptus or pine, or other plant materials such as bamboo, straw and grasses.

Cellulose is separated, e.g., by the kraft process from the woods and other plant materials and is obtained as a so-called pulp, which generally consists of more than 90 wt. %, in particular to more than 92 wt. %, particularly preferably more than 96% of cellulose.

The average degree of polymerization (DP) of the cellulose in the pulp may be, e.g., from 200 to 2000. The DP value indicates the average number of glucose units per cellulose chain.

The average degree of polymerization of the cellulose can be reduced by breaking up the polymer chains. For this purpose, dissolved cellulose can be exposed to elevated temperature and/or treated with acids or bases.

It is an advantage of the process according to the invention that cellulose with a high DP can also be used and pretreatment of the cellulose or post-treatment of the cellulose dissolved in the spinning solution to reduce the DP is not necessary.

The spinning solution produced and used in the further process therefore preferably contains a dissolved cellulose having a DP of 200 to 2000, particularly preferably from 300 to 1000 and very particularly preferably from 400 to 800.

The spinning solution contains the above ionic liquid as a solvent. In addition to the ionic liquid, the spinning solution may contain other solvents. These further solvents should preferably be miscible with the ionic liquid and be used only in amounts such that the solubility of the polymers, or of the cellulose, in the solution is not impaired. In particular, polar, protic solvents such as methanol, ethanol or water in amounts of less than 10 parts by weight, in particular less than 3 parts by weight per 100 parts by weight of ionic liquid are suitable. In a particularly preferred embodiment, the content of other solvents in the spinning solution is less than 1 part by weight and in particular less than 0.1 parts by weight per 100 parts by weight of ionic liquid.

The content of the cellulose in the spinning solution is preferably 6 to 20 parts by weight, particularly preferably 10 to 14 parts by weight per 100 parts by weight of ionic liquid.

The spinning solution may contain other ingredients. Suitable components include, e.g., water to adjust the flow properties and/or flame retardants and or pigments, in particular for dyeing the fiber.

A preferred water content is e.g. 0.1-5 wt %, based on the total spinning solution. The content of pigments or active ingredients such as stabilizers, e.g., antioxidants, antibacterial agents, UV inhibitors, etc., may be, e.g., 0.1 to 2 wt. %, based on the total spinning solution.

The spinning solution can be produced by conventional processes. Thus, e.g., cellulose may be mixed with the ionic liquid and dissolved at elevated temperature. The polymer, or the cellulose, may optionally be mechanically comminuted beforehand, e.g. by a grinding process to simplify the dissolution process. In a mechanical comminution, it may be helpful to use swollen polymer or cellulose. Suitable swelling agents are, in particular, the non-solvent described below.

The dissolution process is generally assisted by mechanical measures such as stirring. In particular, the solution process can also be improved or accelerated by ultrasound. If the spinning solution should contain other ingredients, these other ingredients may be introduced, e.g., together with the cellulose or subsequently.

In a preferred embodiment, the polymer, or the cellulose, is dissolved in the ionic liquid using an auxiliary liquid which does not or only partially dissolves the polymer, or the cellulose (also referred to below as non-solvent). The non-solvent is substantially or completely removed during the dissolution process, preferably by distillation, and is then contained in the spinning solution only in the amounts of the other solvents specified above. The non-solvent is preferably miscible with the ionic liquid.

The spinning solution in process step a) is therefore preferably obtained by a1) producing a heterogeneous mixture of polymer, a non-solvent and optionally ionic liquid, and a2) distilling off the non-solvent.

Suitable non-solvents for cellulose are in particular water and alkanols, preferably water and methanol, more preferably water.

The amount of non-solvent is preferably at least 30 parts by weight, particularly preferably at least 50, very particularly preferably at least 80 parts by weight of non-solvent based on 100 parts by weight of polymer, or cellulose. The non-solvent can be used in large excess. However, since it is removed, it is preferred to use not more than 200 parts by weight, especially not more than 150 parts by weight of non-solvent per 100 parts by weight of polymer.

Preferably, in a1) ionic liquid is used, and a heterogeneous mixture is obtained which contains the cellulose, the non-solvent and the ionic liquid.

In a particularly preferred embodiment, the total amount of the ionic liquid is used in a1) and a heterogeneous mixture is obtained which contains the cellulose, the non-solvent and the ionic liquid in the amounts indicated above.

As far as only a portion of the ionic liquid is used, the rest may be added, e.g., during the removal of the non-solvent by distillation, or may be added subsequently to the spinning solution.

The formation of the solution of the polymer, or of the cellulose, takes place during the distilling off of the non-solvent in a2).

The non-solvent is preferably distilled off at a temperature of 50 to 150° C., particularly preferably at a temperature of 80 to 130° C.

In a preferred embodiment the distilling off is carried out at a reduced pressure, that is, at a pressure less than 1 bar, in particular at a pressure of at most 500 millibar, particularly preferably of at most 100 millibar, and very particularly preferably at a maximum of 40 millibar. The pressure may be, e.g., 5 to 500 millibar, in particular 20 to 100 mbar.

In a particularly preferred embodiment a thin film evaporator is used for distilling off the non-solvent. In this case, it may be, e.g., a falling film evaporator or a rotary evaporator.

Preferably, it is a rotary evaporator. This is generally a cylinder that contains a rotor inside. The wall distance between the cylinder and rotor is preferably at most 10 millimeters, particularly preferably at most 1 millimeter. The cylinder is heated. Mixing elements, e.g., wiper blades, that are mounted on the rotor ensure good mixing of the heterogeneous mixture during distillation.

The heterogeneous mixture obtained in a1) is preferably introduced at the top of the heated cylinder. The heterogeneous mixture is distributed on the inner wall of the cylinder. The non-solvent, preferably water, evaporates and the cellulose goes into solution. At the bottom of the cylinder, the resulting spinning solution can be removed. The discharge of the spinning solution can be accomplished by conventional pumps, e.g., a gear pump.

Using the thin film evaporator, the production of the solution can be carried out continuously and the spinning solution at the outlet can be continuously fed to the further spinning process. Using the thin-film evaporator, a spinning solution is obtained which is free of gas bubbles and which has a very high homogeneity.

The thin-film evaporator may be operated, e.g., at a pressure of 40-80 millibar, a temperature of 80-130° C., and a throughput of 0.5-2 kg/h heterogeneous mixture. For larger thin-film evaporators, of course, a larger throughput is possible.

The Process Step b)

In process step b, the spinning solution obtained in a) is guided through an extruder.

In a preferred embodiment, the spinning solution obtained in a) is first filtered before being fed to the extruder. By the filtration undissolved components should be separated.

Preferably, the filtration is carried out under pressure, in particular, a pressure filter vessel is suitable for carrying out the filtration. The filtration is preferably carried out at a pressure of at least 1.2, in particular at least 1.5 bar. More than 3 bar are generally not necessary.

In a preferred embodiment, after process step a) and a preferably subsequent filtration, the spinning solution passes directly into the extruder.

The extruder preferably consists essentially of an outer shell, generally in the form of a cylinder, and at least one screw conveyor inserted therein.

Preferably, this is an extruder with one or two screws, in particular, it is an extruder with one screw.

The channel depth can remain the same over the entire length of the screw or change.

In a preferred embodiment, the screws are core-progressive, that is, that the channel depth at the inlet of the extruder is greater than the channel depth at the outlet of the extruder. In particular, the ratio of the channel depth at the inlet to that at the outlet is 1.2:1 to 3:1, particularly preferably 1.5:1 to 2:1.

Conventional screws with a screw diameter D of, e.g., 5 to 500 millimeters can be used. In the process according to the invention, screw diameters D of 5 to 250 millimeters are preferred; particularly preferred are 5 to 50 millimeters and in particular a screw diameter D of 10 to 50 millimeters.

The length of the screws is usually given as a multiple of D. Preferred screw lengths are 10 to 50 D, in particular 15 to 30 D.

The speed of the screws is preferably 10 to 300, more preferably 25 to 100 revolutions per minute.

The temperature of the spinning solution in the extruder is preferably 20 to 150° C., especially 40 to 120° C., very particularly preferably 40-90° C.

The pressure with which the spinning solution is conveyed through the extruder may be, e.g., 10 to 200 bar, in particular 15 to 150 bar, very particularly preferably 20 to 120 bar.

After passage through the extruder, the spinning solution reaches the spinning head by means of a pump, e.g., a gear pump. The spinning head generally includes a final filtration device and a distributor block to distribute the spinning solution as evenly as possible over all the holes of the die and the die. When passing through the die, the spinning solution is divided into polymer fibers.

Suitable dies have a hole diameter D of 90-60 μm.

The ratio of length of the holes L (also called capillary length) to hole diameter, the L/D ratio in short, can be, e.g., 2/1 to 8/1.

The throughput of the spinning solution through the extruder depends on the number of holes of the die and the pressure. At pressures of 15 to 150 bar and a number of holes of 168, the throughput may be, e.g., 3 to 20 $cm^3$/min; for a die with a number of holes of 1000, the throughput may be, e.g., 17 to 119 $cm^3$/min.

If connecting elements between the devices are present, these connecting elements in the simplest case and therefore preferably are connecting lines, in particular piping.

Process steps b) to c) are preferably carried out continuously; particularly preferably all process steps a) to c) are carried out continuously. Therefore, all elements and devices which contain or convey the spinning solution produced in a), including any connecting lines between the devices, are heated or—in the case of short lines—preferably sufficiently insulated, so that the temperature of the spinning solution is as constant as possible, so as to ensure good flow properties in all process steps until exiting the die.

The Process Step c)

The spinning solution is divided into fibers by means of the die. Initially, the fibers consist of the spinning solution. The exit velocity of the spinning solution, or of the forming fibers, from the die is, e.g., 2.5 to 40 m/min, preferably 4 m/min to 30 m/min, particularly preferably 5.5 to 20 m/min.

The fibers obtained by passing through the die are guided through an air gap through a coagulation bath.

The width of the air gap may be e.g. 5 millimeters (mm) to 50 mm. Preferably, the width of the air gap is 8 to 20 mm.

Preferably, the fibers are drawn in the air gap. By drawing the fiber is extended and the polymer is simultaneously oriented in the pulling direction.

After exiting the die, the fiber is transported via so-called godet duos, as is typical for spinning processes. Godet duos are two rotating rollers, which are arranged one above the other. They serve as drives for forwarding the fiber. Both rollers rotate at the same speed in the same direction and have the same diameter, moreover, they are generally not quite parallel to one another, but at a slight angle. This angle causes a distance between the wraps with several wraps of the fiber around both rollers. This prevents the fibers from touching and being mechanically damaged.

The drawing can therefore be effected in a simple manner by an increased transport speed of the godet duos. If this speed is higher than the exit speed of the fiber from the die, the fiber is drawn accordingly directly after exiting the die.

The degree of drawing results from the ratio of the transport speed of the godet duos to the exit speed of the fiber from the die. Without drawing, i.e., at the same speeds, the resulting degree of drawing is 1. The degree of drawing is preferably from 1.5 to 3.5, particularly preferably from 1.8 to 3.5.

The transport speed of the godet duos can be, e.g., 1 to 200 meters (m)/minute (min). Preferably, it is 15 to 40 m/min.

After the air gap, the fibers enter the coagulation bath. The coagulation bath contains a non-solvent for the polymer, or for the cellulose. Non-solvents are described above. Preferred non-solvent is water. In addition to the non-solvent, the coagulation bath may also contain solvents which dissolve the polymer, e.g., ionic liquid. When immersing into the coagulation bath, the fiber generally still contains ionic liquid from the spinning solution and releases it to the coagulation bath. In this way ionic liquid accumulates over time in the coagulation bath. The content of ionic liquid or other solvents dissolving the polymer, or the cellulose, should preferably be kept so low that the coagulation of the polymer is not significantly affected. Particularly preferably, the coagulation bath should contain not more than 30 wt %, very particularly preferably not more than 10 wt % of such solvents. The percentages are based on the total weight of the coagulation bath.

The temperature of the coagulation bath is generally not elevated, it can be, e.g., between 10 and 30° C.

The contact time of the fiber in the coagulation bath may be, e.g., 1 seconds to 60 seconds, preferably it is 5 to 20 seconds.

After passing through the coagulation bath, the fibers are substantially solidified in their structure and are hardly changed in their mechanical properties by the subsequent process steps, such as washing, finishing with additives, drying and winding.

In general, the fiber passes through several wash baths, e.g., water baths, so as to remove the ionic liquid as completely as possible from the fiber. This can be followed by finishing baths for the fiber. These are, e.g., water baths containing conventional additives, e.g., phosphorus compounds as fire retardants or surface treatment additives. The latter prevent a later sticking together of the rolled up fiber. The drying can be carried out by heatable godet duos and/or supply of hot air in a heating channel. Finally, the fiber is wound up.

The fibers finally produced in process step c), which are also referred to as filaments, are so-called continuous fibers, or continuous filaments. In contrast to so-called staple fibers, the continuous fibers are not purposefully cut but obtained at the end of the production process as rolled-up fibers.

The process according to the invention provides fibers, e.g., cellulosic fibers, with very good application properties.

In particular, cellulosic fibers with a defibrillation grade of 1 to 2.5 can be obtained with the process.

The term defibrillation refers to the formation or presence of fibrils, i.e., fine hairs, which protrude from the fiber; these fibrils are generally undesirable for textile applications because they make the fiber rough.

Defibrillation is assessed visually by a defibrillation grade. For this purpose, the fibers are added to water and shaken. The presence of protruding fibrils is then examined under the microscope. For assessment grades from 1 to 6 are given. At grade 1 there are no fibrils (no defibrillation), at grade 6 the fiber is completely fibrillated.

The thickness of the obtained cellulosic fibers is preferably 2-20 μm.

The fineness of the fiber, i.e., weight based on fiber length, is preferably 1-4 dtex.

The unit tex represents grams on 1000 meters of fiber; 1 dtex equals 0.1 tex or grams per 10000 meters of fiber.

The maximum tensile force of the fiber is in particular 10 to 100 cN/tex, particularly preferably 20 to 60 cN/tex.

The elongation at break of the fiber is in particular 1 to 30%, particularly preferably 10 to 30%, e.g., 12 to 20%.

EXAMPLES

Compounds and Raw Materials Used in the Examples:

EMIM octanoate: 1-ethyl-3-methylimidazolium octanoate (R1 in formula I is ethyl and R3 in formula I is methyl), EMIM octanoate is an ionic liquid, hereinafter also referred to as IL for ionic liquid)

Cellulose: Eucalyptus sulfide pulp (Examples 1 to 5) and cotton linters in Examples 6 to 11.

Examples 1 to 5

In these examples cellulosic fibers were prepared as described below:

Production of the Spinning Solution

First, a heterogeneous mixture of the following ingredients was produced.

11 weight percent cellulose, eucalyptus pulp
8.1 weight percent of water, and
80.9 weight percent octanoate For this purpose, EMIM octanoate was treated with ice, since warming occurs when water is added. Then, the cellulose was added. The mixture was mixed for about 45 minutes in an "AMK kneader" at 40 rpm and room temperature.

The water was then distilled off in a thin-film evaporator (type: VD 83-6-RRS-11 from VTA):

Rotation speed: 400 rpm
Jacket temperature 120° C.
Temperature discharge pump: 110° C.
Vacuum: 60 mbar After the distillation, a spinning solution with 12 wt % of dissolved cellulose was obtained.

Characterization of the Spinning Solution:

The characterization of the spinning solution is carried out by means of a rheometer. Rheological assessments serve primarily to check the spinnability of a textile pulp. Important parameters here are the zero-shear viscosity, i.e., the theoretical viscosity at no load and the crossover, i.e. the point at which the loss and storage modulus are the same. Frequez sweep tests are performed to obtain these quantities. In addition, the spinning solution should have pseudoplastic properties and should not be a gel. Since spun over an air gap, the solution must have sufficiently large elastic properties to form stable filaments, but these filaments must also be drawn. Therefore, it should have sufficiently viscous properties.

In this case, depending on the temperature, the spinning solution had a zero shear viscosity of 1000 Pas at 110° C., or 20000 Pas at 50° C., and a crossover at about 16 rad/s at 110° C.) or about 0.8 rad/s at 50° C. It also had pseudoplastic properties up to 50° C. These values were determined with a Rheometrics "Dynamic Stress Rheometer SR 500". The measuring head was a 25 mm diameter plate. A force-controlled frequency sweep was measured. The frequency ranged from 100 rad/s to 0.1 rad/s at a force of 100 Pas. This measurement was carried out in each case at 110° C. to 40° C. descending in 10 K steps. The measuring gap was 1 mm.

Processing of the Spinning Solution

The spinning solution was transferred to a "pressure filtration tank 10 liter" from Karl Kurt Juchheim. The filter used was a metal mesh made of austenitic stainless steel, material number 1.4401 with a mesh size of 0.043 mm and a wire thickness of 0.035 mm.

The filtration unit was positioned on a rack over the extruder. The pressure filter tank was connected to the intake at the extruder by means of a heatable transfer line.

The extruder was an extruder called Haake Polylab Rheocord. The screw of the extruder was core progressive with a ratio of channel depths of 2 to 1, i.e., the channel depth is twice as large at the inlet than at the outlet. The diameter of the screw was 19 mm, the length 25×diameter, i.e. 475 mm.

The textile pulp was guided into the extruder through the filter by means of a pressure of 2 bar. In the extruder, the textile pulp was transported by a screw to the spinning pump. The spinning pump used was a Feinprüf gear pump with a displacement of 0.6 $cm^3$/rev.

The spinning solution was guided through the spinning head, where it was evenly distributed on the die by means of another filter and a distribution block. The die used here has a hole diameter of 60 μm with an L/D ratio of 2/1, has 168 holes and is from Enka Technika. This complete setup from the pressure filtration to the die was heated to the spinning temperature.

The filaments emerging from the die were guided through an air gap of 10 mm into a coagulation bath. The coagulant contained water as a non-solvent. The temperature of the coagulation bath was 21° C.

The fiber was deflected after an immersion depth of 300 mm and withdrawn from the coagulation bath via a godet duo with a defined speed, and transported away. Depending on the desired drawing and exit speed, the line speed varied according to the table.

A wet-spinning machine from Fourne was used. It comprises a total of 9 godet duos.

Between the first five of these godet duos there were 3 washing baths each 1200 mm in length. They contained water at a temperature of 88° C. The end of this wash unit was a washing godet duo. Here, the fiber was rinsed one last time continuously with water at room temperature. The washing process took place directly on the godet.

After the washing godet duo, there were two more godet duos for the preparation for use. Between these two drives was an aqueous immersion bath through which the fiber was guided. Through the preparation, that is, by the additives in the immersion bath, the fiber received a non-sticky finishing in the usual way, so as to prevent sticking of the individual filaments during drying.

The drying step was carried out on a heated godet duo at 80° C.

The fiber was then guided through a hot air duct at (1200 mm, 120° C.) and wound after the last godet duo with a tension controlled Oeriklon Barmag winder type WUFF 6E.

The above described production of the cellulosic fibers was repeated under different conditions. The table contains the necessary information on the production and properties of the obtained cellulosic fiber.

The textile-mechanical properties were measured with a "Favimat" from Textechno. In each case, the means were determined from 20 individual fiber measurements.

| | | Example 1 | Example 2 | Example 3 | Example 4 | Example 5 |
|---|---|---|---|---|---|---|
| Solution concentration | [%] | 12 | 12 | 12 | 12 | 12 |
| Spinning temperature | [° C.] | 54 | 60 | 60 | 90 | 90 |
| Exiting speed | [m/min] | 5.9 | 5.9 | 12.8 | 12.8 | 27.8 |
| Line speed | [m/min] | 10.7 | 10.7 | 22.5 | 15 | 39.0 |
| Drawing | [%] | 80 | 80 | 90 | 120 | 40 |
| Drives 1-9 | [m/min] | 10.7 | 10.7 | 22.5 | 28 | 39 |
| Textile-mechanical properties | | | | | | |
| Elongation at break | [%] | 6 | 9 | 6 | 6 | 6 |
| Max. tensile force | [cN/tex] | 37 | 34 | 41 | 51 | 31 |
| Single fiber fineness | [dtex] | 1.8 | 2.0 | 1.8 | 1.7 | 2.4 |
| Modulus of elasticity | [cN/tex] | 1900 | 1600 | 1900 | 1900 | 1600 |

Example 6-8

Execution as in example 1-5. The pulp used was cotton linters. The alpha cellulose content leads to much improved fiber properties

| | | Example 6 | Example 7 | Example 8 |
|---|---|---|---|---|
| Solution concentration | [%] | 12 | 12 | 12 |
| Spinning temperature | [° C.] | 54 | 60 | 60 |
| Exiting speed | [m/min] | 5.9 | 5.9 | 12.8 |
| Line speed | [m/min] | 13.6 | 14.1 | 22.5 |
| Drawing | [%] | 130 | 140 | 90 |
| Drives 1-9 | [m/min] | 13.6 | 14.1 | 22.5 |
| Textile-mechanical properties | | | | |
| Elongation at break | [%] | 5 | 6 | 6 |
| Max. tensile force | [cN/tex] | 56 | 57 | 46 |
| Single fiber fineness | [dtex] | 1.2 | 1.3 | 1.8 |
| Modulus of elasticity | [cN/tex] | 2400 | 2300 | 2200 |

Example 9-11 (Comparative Examples)

Execution was as in Example 6-8, but without screw extruder:

The drawing could not be achieved. A summary of the fiber properties at max. drawing compared to Example 6-8 is shown in the following table:

| | | Example 9 | Example 10 | Example 11 |
|---|---|---|---|---|
| Solution concentration | [%] | 12 | 12 | 12 |
| Spinning temperature | [° C.] | 54 | 60 | 60 |
| Exiting speed | [m/min] | 5.9 | 5.9 | 12.8 |
| Line speed | [m/min] | 8.5 | 10.2 | 17.9 |
| Drawing | [%] | 45 | 70 | 40 |
| Drives 1-9 | [m/min] | 8.5 | 10.2 | 17.9 |
| Textile-mechanical properties | | | | |
| Elongation at break | [%] | 14 | 16 | 15 |
| Max. tensile force | [cN/tex] | 23 | 29 | 21 |

-continued

| | | Example 9 | Example 10 | Example 11 |
|---|---|---|---|---|
| Single fiber fineness | [dtex] | 2.6 | 2.5 | 3.2 |
| Modulus of elasticity | [cN/tex] | 800 | 900 | 600 |

The invention claimed is:

1. A process for the production of cellulosic fibers from cellulose dissolved in ionic liquids by means of an air gap spinning process, the process comprising:

a) preparing a spinning solution by:

a1) producing a heterogeneous mixture of cellulose, water as a non-solvent which does not or only partially dissolve the cellulose, and ionic liquid, and a2) distilling off the water in a thin-film evaporator such that the spinning solution contains per 100 parts by weight of ionic liquid, less than 3 parts by weight of water, and 6 to 20 parts by weight of dissolved cellulose which results in pseudo plastic properties of the spinning solution, b) guiding the spinning solution of a2 through an extruder before it is divided into fibers via a die, and c) guiding the fibers via an air gap through a coagulation bath, wherein the fibers are drawn in the air gap.

2. The process according to claim 1, characterized in that the cation of the ionic liquid is an organic, heterocyclic cation having one to three nitrogen atoms as part of a heterocyclic ring system of the organic, heterocyclic cation, and the anion of the ionic liquid is a compound having a carboxylate group.

3. The process according to claim 1, characterized in that the cation of the ionic liquid is an imidazolium cation of the following formula I

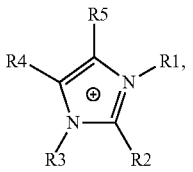

wherein

R1 represents an organic radical with 1 to 20 carbon atoms, and R2, R3, R4 and R5 represent an H atom or an organic radical having 1 to 20 carbon atoms.

4. The process according to claim 1, characterized in that the cellulose has an average degree of polymerization DP of 200 to 2000.

5. The process according to claim 1, characterized in that the distilling off of the non-solvent is carried out at a temperature of 50 to 150° C. and a pressure of less than 1 bar.

6. The process according to claim 1, characterized in that in process step b) a temperature of the spinning solution in the extruder is 40 to 120° C.

7. The process according to claim 1, characterized in that the fibers are drawn after passage through the die, wherein a degree of drawing is 1.5 to 3.5.

8. The process according to claim 1, characterized in that a contact time in the coagulation bath is 1 second to 60 seconds.

9. The process according to claim 1, characterized in that process steps a) to c) are carried out continuously.

10. The process according to claim 1, characterized in that the fibers are cellulosic fibers with a defibrillation grade of 1 to 2.5.

11. The process according to claim 1, characterized in that the spinning solution of a) contains per 100 parts by weight of ionic liquid, 0.1 to 1 parts by weight of water, and 10 to 14 parts by weight of cellulose.

12. The process according to claim 1, characterized in that the spinning solution of a) with pseudo plastic properties is not a gel.

13. The process according to claim 1, characterized in that the ionic liquid is selected from 1-ethyl-3-methylimidazolium acetate, 1-methyl-3-methylimidazolium acetate, 1-ethyl-3-ethylimidazolium acetate, 1-methyl-3-methylimidazolium octanoate, 1-ethyl-3-ethylimidazolium octanoate, and mixtures thereof.

14. The process according to claim 1, characterized in that the extruder is a core-progressive screw extruder.

15. A process for the production of cellulosic fibers from cellulose dissolved in ionic liquids by means of an air gap spinning process, the process comprising:

a) preparing a spinning solution by:

a1) producing a heterogeneous mixture of cellulose, water as a non-solvent which does not or only partially dissolve the cellulose, and ionic liquid, and a2) distilling off the water in a thin-film evaporator such that the spinning solution contains per 100 parts by weight of ionic liquid, less than 3 parts by weight of water, and 6 to 20 parts by weight of dissolved cellulose which results in pseudo plastic properties of the spinning solution, b) guiding the spinning solution of a2 through an extruder before it is divided into fibers via a die, and c) guiding the fibers via an air gap through a coagulation bath; and wherein the spinning solution of a) has a crossover at about 16 rad/s at 110° C.

* * * * *